US010266379B2

(12) United States Patent
Schöttke et al.

(10) Patent No.: US 10,266,379 B2
(45) Date of Patent: Apr. 23, 2019

(54) INDUSTRIAL TRUCK COMPRISING A DEVICE FOR REDUCING TRANSVERSE VIBRATIONS

(71) Applicant: Jungheinrich Aktiengesellschaft, Hamburg (DE)

(72) Inventors: Carsten Schöttke, Moosburg (DE); Ernst-Peter Magens, Ammersbek (DE); Jürgen Schmalzl, Haimhausen (DE); Hubert Bibernell, Landshut (DE)

(73) Assignee: JUNGHEINRICH AKTIENGESELLSCHAFT, Hamburg (DE)

( * ) Notice: Subject to any disclaimer, the term of this patent is extended or adjusted under 35 U.S.C. 154(b) by 0 days.

(21) Appl. No.: 15/498,515

(22) Filed: Apr. 27, 2017

(65) Prior Publication Data

US 2017/0313565 A1 Nov. 2, 2017

(30) Foreign Application Priority Data

May 2, 2016 (DE) ..... 10 2016 207 523

(51) Int. Cl.
*B66F 9/14* (2006.01)
*B66F 9/20* (2006.01)
(Continued)

(52) U.S. Cl.
CPC ..... *B66F 9/20* (2013.01); *B66F 9/07* (2013.01); *B66F 9/07559* (2013.01); *B66F 9/10* (2013.01);
(Continued)

(58) Field of Classification Search
CPC ..... B66F 9/07559; B66F 9/122; B66F 9/148
(Continued)

(56) References Cited

U.S. PATENT DOCUMENTS 3,561,628 A 2/1971 Melin
3,937,346 A 2/1976 van der Laan
(Continued)

FOREIGN PATENT DOCUMENTS

CN 105668462 6/2016
DE 2512521 9/1976
(Continued)

OTHER PUBLICATIONS

U.S. Appl. No. 15/631,096 , "Non-Final Office Action", dated Nov. 16, 2018, 11 pages.
(Continued)

*Primary Examiner* — James Keenan
(74) *Attorney, Agent, or Firm* — Kilpatrick Townsend & Stockton LLP

(57) ABSTRACT

The invention relates to an industrial truck, in particular a tri-lateral stacker. The industrial truck may include a lateral pusher having a degree of freedom of movement that is oriented laterally, transversely to the main direction of travel of the industrial truck, and a lateral push drive device that can be controlled by a control device of the industrial truck for moving the lateral pusher along a lateral push frame. The industrial truck may include a device for reducing transverse vibrations, such as vibration components that are transverse to the main direction of travel of the industrial track. In a vibration-damping operating mode, the lateral push drive device can be operated as a component of the device for reducing vibrations, wherein the device allows the lateral pusher to move relative to the lateral push frame so as to reduce vibrations.

16 Claims, 3 Drawing Sheets

(51) Int. Cl.

| | |
|---|---|
| ***B66F 9/075*** | (2006.01) |
| ***B66F 9/07*** | (2006.01) |
| ***B66F 9/10*** | (2006.01) |
| ***B66F 9/22*** | (2006.01) |
| ***B66F 9/24*** | (2006.01) |
| ***B66F 17/00*** | (2006.01) |

(52) U.S. Cl.
CPC ..... *B66F 9/148* (2013.01); *B66F 9/22* (2013.01); *B66F 9/24* (2013.01); *B66F 17/003* (2013.01)

(58) Field of Classification Search
USPC ..... 187/237; 414/662–672, 785
See application file for complete search history.

(56) References Cited

U.S. PATENT DOCUMENTS

| | | | | |
|---|---|---|---|---|
| 4,218,170 | A | 8/1980 | Goodacre | |
| 4,439,102 | A | 3/1984 | Allen | |
| 5,657,834 | A | 8/1997 | Plaugher et al. | |
| 7,736,115 | B2 | 6/2010 | Lambert | |
| 7,980,807 | B2 * | 7/2011 | Schoenauer | B66F 9/148 198/468.6 |
| 8,078,368 | B2 | 12/2011 | Hall | |
| 8,944,744 | B2 * | 2/2015 | Kleeberger | B66F 9/07545 187/222 |
| 9,403,667 | B2 * | 8/2016 | McCabe | B66F 9/07559 |
| 9,890,025 | B2 * | 2/2018 | Colantonio | B66F 9/063 |
| 10,046,812 | B2 * | 8/2018 | Schmalzl | B66F 9/07559 |
| 2005/0156391 | A1 | 7/2005 | Krenzin et al. | |
| 2006/0182588 | A1 | 8/2006 | Beckett et al. | |
| 2007/0116548 | A1 | 5/2007 | Cooper | |
| 2009/0312875 | A1 * | 12/2009 | Lehtonen | B66F 9/07559 700/280 |
| 2009/0314582 | A1 | 12/2009 | Meijer | |
| 2015/0040481 | A1 | 2/2015 | Stover et al. | |
| 2016/0214659 | A1 | 7/2016 | Schmalzl et al. | |
| 2017/0313563 | A1 | 11/2017 | Magens et al. | |
| 2017/0327362 | A1 | 11/2017 | Schmalzl et al. | |
| 2017/0349418 | A1 | 12/2017 | Schmalzl et al. | |
| 2017/0369293 | A1 | 12/2017 | Schmalzl et al. | |
| 2017/0369294 | A1 | 12/2017 | Magens et al. | |

FOREIGN PATENT DOCUMENTS

| | | |
|---|---|---|
| DE | 8806324 | 8/1988 |
| DE | 3925668 | 2/1991 |
| DE | 4016497 | 11/1991 |
| DE | 4019075 | 12/1991 |
| DE | 10054789 | 5/2002 |
| DE | 10055751 | 5/2002 |
| DE | 10240851 | 5/2003 |
| DE | 102004002188 | 8/2005 |
| DE | 102004045698 | 3/2006 |
| DE | 602004001979 | 3/2007 |
| DE | 102008020592 | 10/2009 |
| DE | 102008020595 | 10/2009 |
| DE | 102013014094 | 3/2015 |
| DE | 102013113428 | 6/2015 |
| DE | 202015004375 | 4/2016 |
| DE | 102015201098 | 7/2016 |
| EP | 2368832 | 6/2013 |
| EP | 2881358 | 6/2015 |
| FR | 2243144 | 4/1975 |
| GB | 2379434 | 9/2004 |
| JP | H04130294 | 11/1992 |
| JP | 2004277068 | 10/2004 |
| JP | 2006160406 | 6/2006 |

OTHER PUBLICATIONS

U.S. Appl. No. 15/498,514 , "Non-Final Office Action", dated Sep. 4, 2018, 13 pages.
U.S. Appl. No. 15/592,236 , "Non-Final Office Action", dated Aug. 10, 2018, 11 pages.
U.S. Appl. No. 15/610,753 , "Non Final Office Action", dated Dec. 28, 2018, 7 pages.
U.S. Appl. No. 15/498,514, "Final Office Action", dated Feb. 11, 2019, 11 pages.

* cited by examiner

INDUSTRIAL TRUCK COMPRISING A DEVICE FOR REDUCING TRANSVERSE VIBRATIONS

CROSS REFERENCE TO RELATED APPLICATION

This application claims priority to German Patent Application No. 10 2016 207 523.3, filed in Germany on May 2, 2016, the entire contents of which are hereby incorporated herein by this reference.

The invention relates to an industrial truck, in particular a tri-lateral stacker, comprising a mast, a lateral push frame that can move up and down on the mast, a lateral pusher that is mounted on the lateral push frame so as to be laterally movable transversely to the main direction of travel of the industrial truck, so that said apparatus has a degree of freedom of movement that is oriented laterally, transversely to the main direction of travel of the industrial truck, a load-supporting apparatus that is arranged on the lateral pusher and can move laterally, together with the lateral pusher, transversely to the main direction of travel of the industrial truck using its degree of freedom of movement, a lateral push drive device that can be controlled by a control device of the industrial truck for moving the lateral pusher and the load-supporting apparatus together along the lateral push frame, and comprising a device for reducing transverse vibrations, in particular vibrations having vibration components that are transverse to the main direction of travel of the industrial truck.

The invention can be used particularly advantageously in sideloaders and high-bay stacker trucks, in particular in tri-lateral stackers for picking orders, in which load-supporting fork arms are or can be oriented transversely to the straight direction of travel (main direction of travel) of the industrial truck for lateral push operations. Sideloaders of this kind designed as high-bay stacker trucks make it possible to combine stacking and unstacking of entire palettes and picking individual articles from the high bay without difficulty.

High-bay stacker trucks of the type considered here include those in which a cab is arranged on the mast such that it can be moved up and down by means of a cab support, a lateral push frame being provided on the front of the cab, which lateral push frame can be moved up and down on the mast together with the cab and supports a lateral pusher comprising a load-supporting apparatus arranged thereon, which pusher can move laterally forwards and backwards, transversely to the straight direction of travel of the industrial truck. Since the cab and an operator located therein can move, together with the load-supporting apparatus, vertically on the mast, such industrial trucks are also referred to as man-up vehicles or man-up industrial trucks. In various designs of man-up industrial trucks, the mast can be telescopically extended and retracted, the cab being height-adjustably fastened to the telescoping stage of the mast that can be extended the highest.

The load-supporting apparatus that is movably guided on the lateral push frame by means of the lateral pusher can comprise an additional mast comprising load-receiving means that can move up and down thereon relative to the driver's platform and are usually load-supporting arms or a load-supporting fork comprising such load-supporting arms. The additional mast is arranged on the lateral pusher and can be pivoted thereon, about a typically vertical axis, by approximately 180° so that the load-supporting fork fastened to the additional mast in a height-adjustable manner can be pivoted out of a position in which it is oriented laterally, transversely to the straight direction of travel of the industrial truck, into a position in which it is oriented in an opposing lateral position. For this reason, in tri-lateral stackers the lateral pusher is often also referred to as a pivoting pusher. The lateral pusher (pivoting pusher) is guided linearly on the lateral push frame so that it has a linear, and usually horizontal, degree of freedom of movement that is transverse to the straight direction of travel of the industrial truck.

A typical task for the industrial truck consists, for example, in place a palette together with the load located thereon in a bay for storage, the industrial truck being in a narrow aisle between bays of a high-bay warehouse and the palette being received on the load-supporting fork. The palette is introduced laterally into the bay, transversely to the straight direction of travel of the industrial truck, it being assumed that the load-supporting fork is already correctly oriented towards the desired storage area so as to be laterally facing the bay, and the pivoting pusher, together with the additional mast provided thereon, is in a lateral end position at the end of the lateral push frame that is remote from the bay in question. By means of the linear, lateral movement of the pivoting pusher along the lateral push frame, the loaded palette can then be introduced into the bay.

Various controllable drive means are provided for driving the different movable components on the mast. Depending on the design of the industrial truck, said drive means are used to move the load-receiving means on the additional mast, to pivot the additional mast about a vertical axis, to move the load-supporting apparatus or the pivoting pusher on the lateral push frame, to move the driver's platform on the mast and optionally to telescopically extend and retract the mast and, in industrial trucks comprising a transfer option, to move the lateral push frame relative to the driver's platform. In this case, the drive means are usually and preferably hydraulic or electrohydraulic drive means, although other drives are not to be ruled out.

It is a known problem that, in industrial trucks of the type considered here, vibrations occur on the mast, in particular transverse vibrations having lateral vibration components, i.e. components that are directed transversely to the straight direction of travel of the industrial truck and are normally horizontal, in particular when travelling over an uneven floor. In high-bay tri-lateral stackers for picking orders, such vibrations are often more severe the higher the driver's platform and the apparatuses on the front thereof are raised on the mast and the greater the load is that is optionally received by the load-supporting apparatus. Such vibrational movements can be unpleasant for an operator located on the driver's platform and make it difficult or sometimes even impossible to place palettes into bays and to remove them therefrom, and therefore the operator can normally only reliably start the placement or removing process once the vibrations have subsided when the industrial truck is stationary. Alternatively, the operator could in principle drive the industrial truck at a slower speed when travelling over an uneven floor in order to prevent the excitation of vibrations as much as possible. Both of these solutions would, however, reduce productivity when working with the industrial truck.

EP 2 368 832 B1 discloses an industrial truck, designed as a man-up vehicle, of the type mentioned at the outset, in which measures for reducing vibrations have already been taken. These measures consist in attaching an assembly, which is referred to as a load-receiving portion, can move up and down on the mast and comprises the interconnected cab and load-supporting apparatus, to the mast such that said entire assembly can carry out movements relative to the mast that have a lateral, i.e. usually horizontal, movement component, and that are transverse to the straight direction of travel (main direction of travel) of the industrial truck, a separate degree of freedom of movement for the assembly that is not intended for the planned operation of the industrial truck being established in this case. The known industrial truck comprises means for damping or preventing vibrations in the relative position between the load-receiving portion and the mast, i.e. between the driver's platform (cab) and the mast. In this case, these means can be active, semi-active and/or passive vibration-damping means, which are suitable for generating a force or a torque between the mast and the load-receiving portion, which force or torque has a component along the separate degree of freedom of movement that is not intended for the planned operation of the industrial truck. For reducing vibrations, EP 2 368 832 B1 proposes, inter alia, damping elements and springs which counteract deflection of the mast and the assembly (referred to as the load-receiving portion) along the separate degree of freedom of movement. A disadvantage of this known solution is that it involves a relatively large amount of installation effort in order to attach the entire assembly, consisting of the driver's platform and all the load-receiving components that can move vertically on the mast together therewith, to the mast while establishing the separate degree of freedom of movement that is not intended for the planned operation of the industrial truck. Retrofitting a relevant industrial truck with said known vibration-reducing measures would also be complicated and laborious.

The object of the invention is to provide an industrial truck of the type mentioned at the outside, which is provided with vibration-reducing measures that are relatively easy to implement in terms of installation and allow for operation that efficiently reduces vibrations, in particular whilst influencing as little as possible the degree of comfort for an operator remaining in an on-board cab.

According to the invention, an industrial truck having the features of claim 1 is proposed, specifically an industrial truck, in particular a tri-lateral stacker, comprising a mast, a lateral push frame that can move up and down on the mast, a lateral pusher that is mounted on the lateral push frame so as to be laterally movable transversely to the main direction of travel of the industrial truck, such that said pusher has a degree of freedom of movement along the lateral push frame that is directed laterally, transversely to the main direction of travel of the industrial truck, a load-supporting apparatus that is arranged on the lateral pusher and that can move laterally, together with the lateral pusher, transversely to the main direction of travel of the industrial truck using its degree of freedom of movement, a lateral push drive device, which can be controlled by a control device of the industrial truck, for moving the lateral pusher and the load-supporting apparatus together along the lateral push frame, and comprising a device for reducing transverse vibrations, in particular vibrations having vibration components that are transverse to the main direction of travel of the industrial truck, the industrial truck being characterised according to the invention in that, when in a vibration-damping operating mode, the lateral push drive device can be operated as a component of the device for reducing vibrations so that, when in the vibration-damping operating mode, said lateral push drive device allows the lateral pusher to perform vibration-reducing movements relative to the lateral push frame.

According to the present invention, the device for reducing vibrations can reduce vibrations directly at the interface between the lateral push frame and the lateral pusher in order to allow vibration-reducing compensatory movements of the lateral pusher relative to the lateral push frame. In this case, the lateral push drive device is operated as a component of the device for reducing vibrations. Developments of the invention are specified in the dependent claims.

A basic concept of the invention consists in coupling the mass of the lateral pusher, together with the load-supporting apparatus supported thereby and optionally a load supported thereon, and the mass of the rest of the vehicle not in a slip-free or rigid manner, but rather coupling them in a "relatively soft" manner, according to the operating circumstances, with regard to the linear degree of freedom of movement of the lateral pusher when the lateral push drive device is in the vibration-damping operating mode, so that the lateral pusher comprising the load-supporting apparatus and the load supported thereon can follow accelerated movements preferably only indirectly, in a delayed, phase-shifted and braked manner in accordance with the inertial effect, which movements occur during mast vibrations and thus in substantially equal-phase vibrations of the lateral push frame connected to the mast by means of a support structure, and, in the process, kinetic energy is converted into another form of energy, in particular heat, by means of a damping system.

The lateral push drive device preferably comprises a controllable hydraulic motor or electric motor having a stator and an active element, in particular a rotor, that can move relative to the stator and the movement of which can be converted into a movement of the lateral pusher along the lateral push frame, it being possible to generate a motor force application, which can be influenced by correspondingly controlling the motor, between the stator and the active element in order to cause the active element and thus the lateral pusher in move or to stop them.

When the lateral push drive device is in the vibration-damping operating mode, the motor can be set so as to generate a holding torque that can be overcome such that the active element counteracts a movement out of its particular position relative to the stator with a resistance.

When the lateral push drive device is in the vibration-damping operating mode, the motor can be actuated so as to generate a holding and restoring torque for holding the active element in a particular target position relative to the stator, and for restoring the active element to the target position if the active element is deflected out of the target position, the motor preferably being controllable such that the holding and restoring torque can be modulated on the basis of the deflection of the active element out of the target position, in particular said torque can be increased proportionally to the deflection of the active element.

A movement-damping arrangement of the device for reducing vibrations is preferably provided, which arrangement acts between the lateral push frame and the lateral pusher when the lateral push drive device is in the vibration-damping operating mode, functions according to the principle of friction, and the friction effect or braking effect of which is preferably adjustable.

According to a preferred embodiment of the invention, a friction coupling, preferably a multiple disc coupling, the brake torque of which can be adjusted, is provided in the drive train of the lateral push drive device, the motor being designed to prevent the active element from moving relative to the stator when the lateral push drive device is in the vibration-damping operating mode, and the friction coupling allowing the lateral pusher to move relative to the lateral push frame in a braked manner as a result of inertial effects, such as can occur in transverse vibrations of the lateral push frame.

According to one embodiment of the invention, the device for reducing vibrations can comprise a resiliently yielding restoring device, the spring restoring force of which is preferably adjustable and which restoring device is designed to force the lateral pusher into a particular target position relative to the lateral push frame if the lateral pusher were to be deflected out of the particular target position when the lateral push drive device is in the vibration-damping operating mode.

The restoring device can comprise, for example, a torsion spring arrangement in a driveshaft in the drive train of the lateral push drive device.

According to one embodiment of the invention, when the lateral push drive device is in the vibration-damping operating mode, the motor can be operated as a controlled, active vibration-damping element in order to drive the lateral pusher to carry out vibration-reducing movements if transverse vibrations occur on the lateral push frame.

According to another embodiment of the invention, when the lateral push drive device is in the vibration-damping operating mode, the motor is or can be actuated such that it does not generate a motor force application between the stator and the active element that moves the active element, but instead allows relative movements between the stator and the active element and thus also between the lateral push frame and the lateral pusher as a result of inertial effects, such as can occur during transverse vibrations of the lateral push frame.

In a specific variant of the last-mentioned embodiment, the motor is a hydraulic motor, which, when the lateral push drive device is in the vibration-damping operating mode, is or can be hydraulically short-circuited by a flow resistor, in particular a butterfly valve, in order to generate a braking effect on relative movements between the stator and the active element of the motor, and thus also between the lateral push frame and the lateral pusher.

According to one embodiment, a possible friction-damping arrangement for the present invention can comprise at least one hydraulic and/or pneumatic friction-damping cylinder.

The damping system preferably also comprises a spring arrangement that is set such that it loads or pre-tensions the lateral pusher towards a particular target position which corresponds, for example, to a position of minimal spring tension or spring deflection of the spring arrangement. A pneumatic or hydro-pneumatic pressure accumulator that is connected to the hydraulic system is also possible as the spring arrangement.

A control device is provided for controlling the motor. Furthermore, sensors can be provided which detect vibrational movements or vibration amplitudes of the mast or components arranged thereon in a height-adjustable manner, the control device being able to process data from said sensors in order to control the device for reducing vibrations in terms of optimised vibration reduction. In this regard, sensors may also be provided which detect the movement of the lateral pusher relative to the lateral push frame.

As already set out above, the present invention can be advantageously used in particular in a tri-lateral stacker, in particular designed as a high-bay order picking stacker truck, in order to reduce transverse vibrations of the mast and components arranged thereon in a height-adjustable manner, i.e. vibrations having movements transverse to the straight direction of travel of the industrial truck. Accordingly, the industrial truck is preferably designed as a side-loader, in particular a tri-lateral stacker, which comprises a load-supporting fork having load-supporting arms as the load-receiving means of the load-supporting apparatus, which arms are or can be oriented transversely to the straight direction of travel of the industrial truck.

According to a development of the invention, the device for reducing vibrations can optionally be activated and deactivated. For this purpose, a controllable locking apparatus may be provided, which couples the lateral pusher to the lateral push frame when the device for reducing vibrations is deactivated, so that the lateral push drive device can either drive or secure the lateral pusher in a substantially slip-free manner relative to the lateral push frame, and which locking apparatus releases the lateral pusher from this coupling when the device for reducing vibrations is activated.

According to one embodiment of the invention, the device for reducing vibrations can be controlled, in particular activated or deactivated, on the basis of the particular operating state of the industrial truck. Depending on the design of this embodiment, the device for reducing vibrations can be controlled for example on the basis of the acceleration and/or travelling speed of the industrial truck, the particular lifting height of the load-supporting apparatus, the mass of the load, the orientation of load-supporting fork arms, impacts, for example when the driving surface is uneven, etc., sensors or other detection means for detecting these parameters being provided. Therefore, according to a variant of the invention, controlling the device for reducing vibrations can change the scale of a slip in the drive coupling between the lateral pusher and the lateral push frame, depending on one or more of these parameters. In one embodiment of the invention, the lower the vibration-reducing requirement, the more rigid or harder the drive coupling can be set between the lateral pusher and the lateral push frame, for example.

Embodiments of the invention are explained in the following with reference to the figures.

Figure 3:
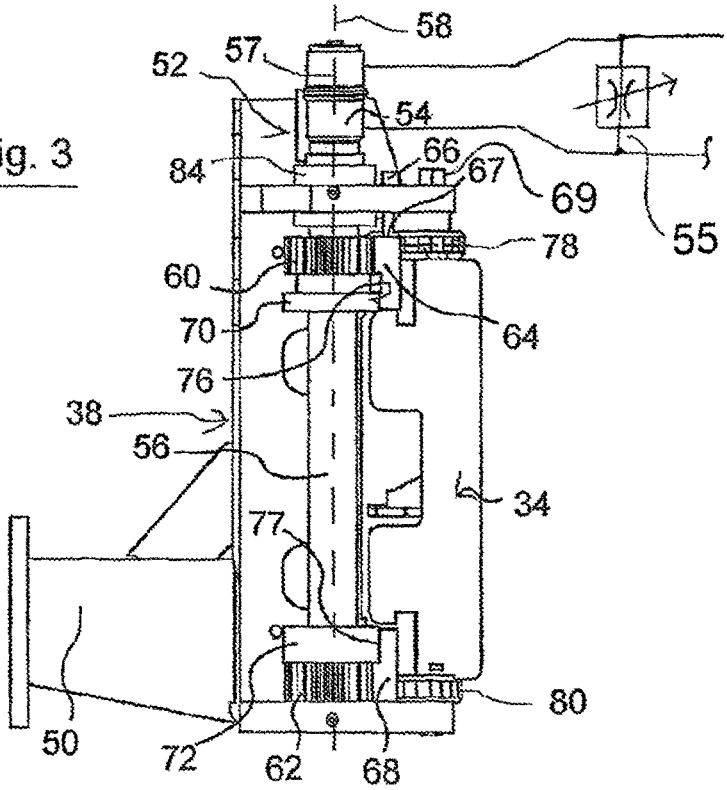
FIG. 3 is a side view of the assembly, shown in isolation, consisting of the lateral push frame and lateral pusher according to one embodiment, the lateral pusher being shown without its outer housing casing so that components of the lateral push drive device are visible.
Figure 4:
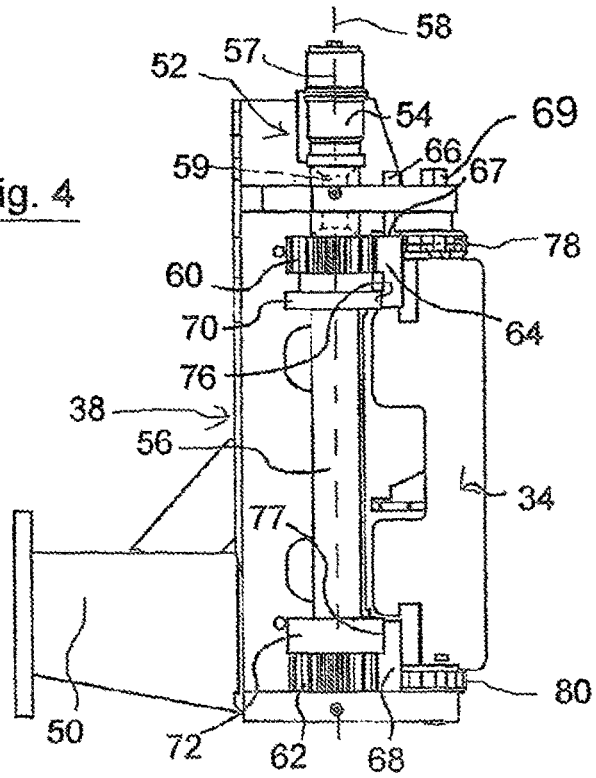

FIG. 4 is a side view of the assembly, shown in isolation, consisting of the lateral push frame and lateral pusher according to another embodiment, the lateral pusher being shown without its outer housing casing so that components of the lateral push drive device are visible, the assembly from FIG. 4 differing from the assembly from FIG. 3 in that there is no coupling in the drive train of the lateral push drive device.

Figure 1:
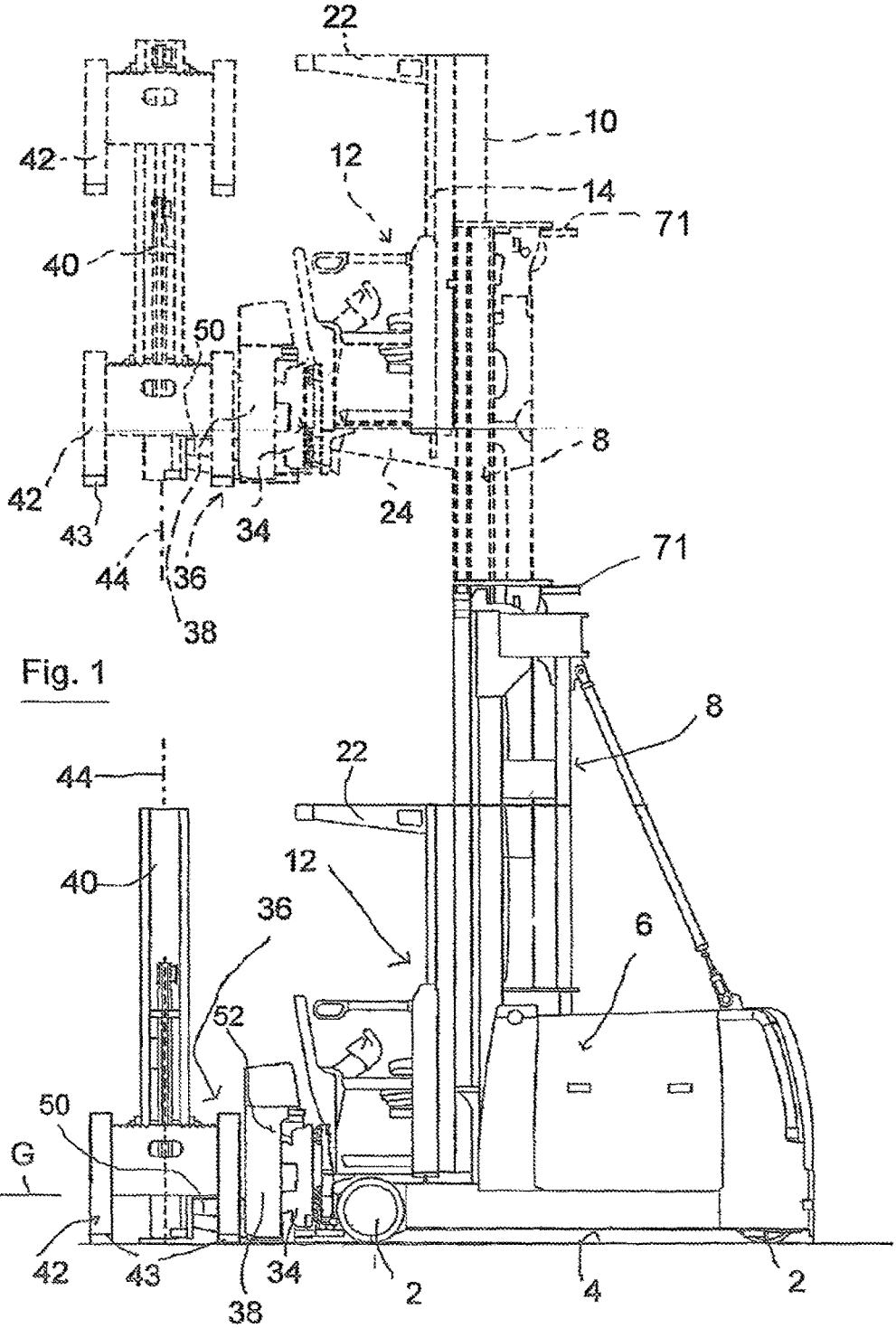
FIG. 1 is a side view of an embodiment of an industrial truck according to the invention, which is designed as a tri-lateral high-bay stacker.
Figure 2:
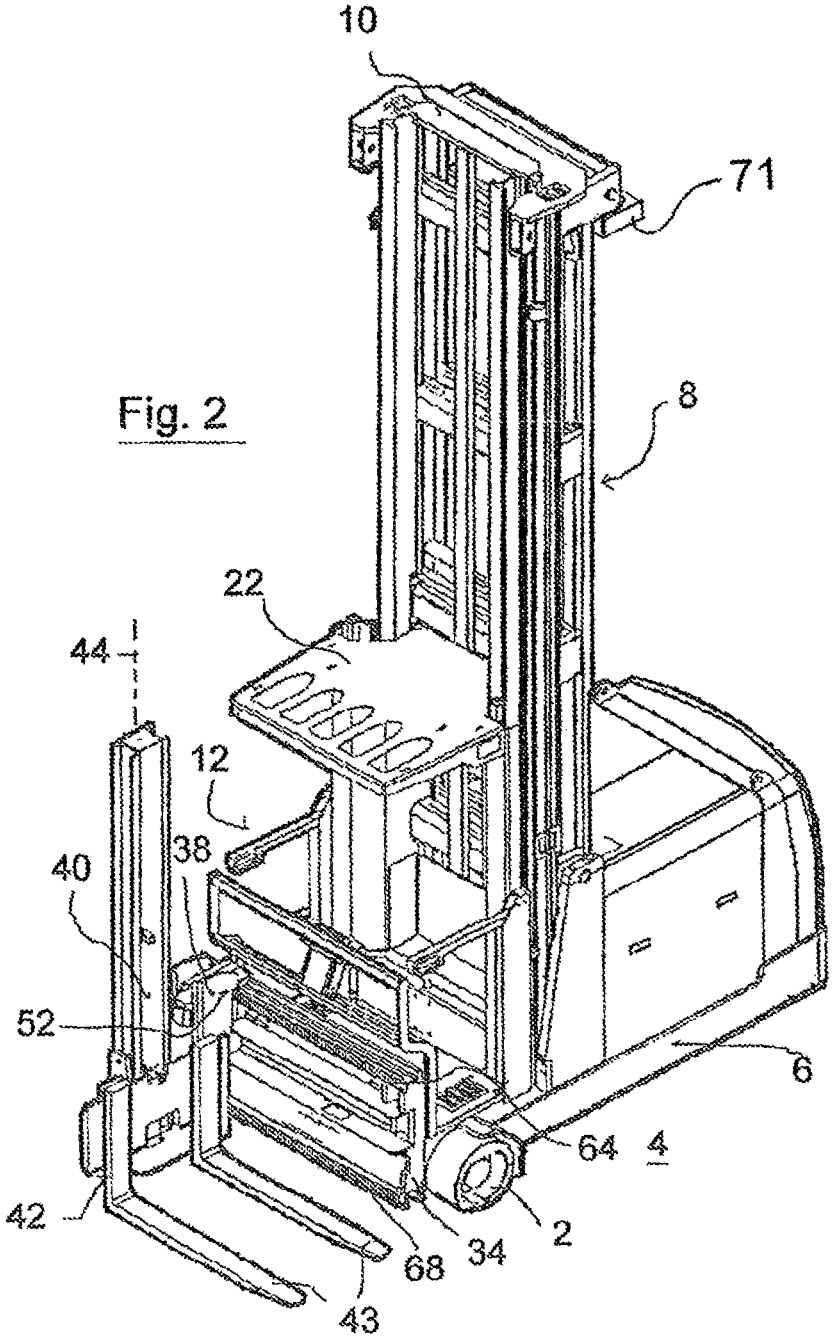
FIG. 2 is a perspective view of a tri-lateral high bay stacker according to the invention that is similar to the tri-lateral high bay stacker from FIG. 1.

For the purposes of explaining the embodiment, the industrial truck in FIG. 1 and the industrial truck in FIG. 2 differ only marginally and are therefore not considered separately, but are jointly referred to and explained as the industrial truck. The industrial truck comprises a chassis 6, which is supported on the floor 4 by means of wheels 2, and a mast 8 that is fastened to the chassis 6 in an upright manner. The mast 8 is telescopically extendable, as can be seen in FIG. 1 from the extended position shown by dashed lines. A cab 12 is attached to the telescoping stage 10 of the mast 8 that can be extended the furthest such that said cab can move vertically. The cab 12 is formed as a raisable driver's cab, which comprises a frame having a cab floor, rear wall 14, side walls and an overhead guard 22 for the driver. A lateral push frame 34 is arranged in front of the cab 12.

A lateral pusher 38 designed as a pivoting pusher 38 and comprising a load-supporting apparatus 36 that is supported thereby is arranged on the front of the lateral push frame 34 so as to be laterally movable, transversely to the straight direction of travel G of the industrial truck. The pivoting pusher 38 comprises an extension arm 50 comprising an additional mast 40 of the load-supporting apparatus 36 that is arranged in the front of said pivoting pusher and on which a load-supporting fork 42, as the load-receiving means, can move vertically. The additional mast 40, together with the load-supporting fork 42, can be pivoted about the vertical axis 44 between the position clearly visible in FIG. 2, in which the load-supporting fork 42 (left-hand side in relation to the straight direction of travel G) is oriented laterally and a position in which the load-supporting fork 42 is oriented in an opposing lateral position.

FIG. 3 is a side view of the lateral push frame 34 and the lateral pusher 38 arranged thereon, with the extension arm 50 shown separately, the lateral pusher 38 being shown without its outer housing casing so that the lateral push drive device 52 is visible.

As already mentioned, the lateral push frame 34 is connected to the mast 8 by a support structure 24 comprising the cab support, and can be moved vertically on the mast together with the cab 12 in a manner known per se (cf. FIG. 1).

The lateral push drive device 52 comprises a rotary drive motor 54 as the motor, in the example a rotary drive motor formed as a hydraulic motor, which is fastened to the lateral pusher 38 by means of an upper motor mounting of the lateral pusher 38 so that the motor housing 57 and thus the motor stator are rigidly connected to the frame of the lateral pusher 38. The motor comprises a rotor as the movable active element, which is coupled to a driveshaft 56 for conjoint rotation. The driveshaft 56 is rotatably mounted on the lateral pusher 38 so that it can be driven by the rotary drive motor 54 so as to rotate about a substantially vertical axis 58. A first pinion 60, which is close to the drive motor, and a second pinion 62, which is remote from the drive motor, are provided on the driveshaft 56 for conjoint rotation, which pinions roll on correspondingly assigned racks 64 and 68, respectively, of the lateral push frame 34, so as to mesh therewith. The racks 64, 68 extend in parallel with one another in the lateral direction, transversely to the main direction of travel of the industrial truck and usually extend horizontally. By rotating the pinions 60 and 62, driven by the drive motor 54, the lateral pusher 38 and its extension arm 50 can therefore be moved relative to the lateral push frame 34 along the racks 64, 68, and therefore laterally transversely to the main drive direction of the industrial truck.

The lateral pusher 38 is guided on the lateral push frame 34 by means of a plurality of rollers. A first roller 66 supports the lateral pusher 38 in the direction of gravity on a first roller race 67 formed next to and in parallel with the rack 64.

Furthermore, a second roller 70, which is near the drive motor, and a third roller 72, which is remote from the drive motor, are provided on the driveshaft 56 near to the pinions 60 and 62, respectively, so as to be rotatable relative to the driveshaft 56, and roll on associated roller tracks 76 and 77, respectively, which are formed next to and in parallel with the racks 64 and 68, respectively. The second and the third rollers 70, 72 support tilting torques about a tilt axis that extends in parallel with the racks 64, 68.

Furthermore, a first guide component 78, which is near the drive motor, and a second guide component 80, which is remote from the drive motor, are provided on the lateral pusher 38 and are used to secure the lateral pusher 38 to the lateral push frame 34 and to guide it thereon.

It should be noted at this point that, in a modified embodiment of the assembly shown in FIG. 3 and FIG. 4, a friction wheel-friction rail arrangement can be provided between the driveshaft and the lateral push frame instead of a pinion-rack arrangement. In this case, the drive force-transmission engagement is then frictional meshing. According to a corresponding embodiment of the invention, the frictional meshing can be modulated in a controlled manner in order to reduce vibrations.

The embodiments of the invention shown put into practice the concept of providing the vibration-damping device between the cab 12 and the load-supporting apparatus 36 and, more specifically, between the lateral push frame 34 and the lateral pusher 38.

In one embodiment of the industrial truck in which the assembly is formed of the lateral push frame 34 and the lateral pusher 38 in the manner shown in FIG. 3, in order to activate the vibration-damping operating mode of the lateral push drive device 52, the motor 54 can be actuated such that it does not provide a drive torque for the driveshaft 56, but instead generates a holding torque which prevents the rotor of the drive motor from rotating relative to the motor stator. In FIG. 3, reference sign 84 is a schematic depiction of a friction coupling, which is interposed between the rotor of the drive motor and the driveshaft 56 and, when the lateral push drive device 52 is in the vibration-damping operating mode, is set such that, by overcoming the friction torque or the coupling force of the friction coupling 84, the driveshaft 56 can carry out rotational movements despite the rotor of the motor 54 being held in place, if, in the case of lateral vibrations of the lateral push frame 34, inertial forces act between the lateral push frame 34 and the lateral pusher 38 and bring about relative movements between the lateral pusher 38 and the lateral push frame 34 due to the braked rotational option of the driveshaft 56. In this case, due to the friction braking effect of the friction coupling, kinetic energy can be converted into heat, so that a vibration-damping effect takes place. If the lateral pusher 38 undesirably shifts out of a particular target position relative to the lateral push frame 34 when the lateral push drive device 52 is in the vibration-damping operating mode, once the vibration triggering the shift has subsided sufficiently, the motor 54 can be activated in a controlled manner in order to move the lateral push frame 34 back into the desired target position.

According to one variant of the above-mentioned embodiment, the coupling 84 can be provided with torsion spring properties, which act in that the drive side (drive-side coupling disc arrangement) and the output side (output-side coupling disc arrangement) constantly force the coupling 84 to assume a common relative target central rotary position, in which the torsion spring restoring force is minimal, whereas the torsion spring restoring force increases the further the coupling disc arrangements rubbing against one are rotationally deflected out of the common target central rotary position.

In one embodiment of the industrial truck in which the assembly is formed of the lateral push frame 34 and the lateral pusher 38 in the manner shown in FIG. 4, a friction coupling of the type indicated in FIG. 3 is not present.

Instead, the assembly in FIG. 4 comprises the same device components as the assembly in FIG. 3. In the embodiment of the lateral push drive device 52 according to FIG. 4, depending on the variant of the device for reducing vibrations, the hydraulic motor 54 can be actuated in different ways in order to activate the vibration-damping operating mode of the lateral push drive device 52.

According to a variant of this type, it is provided for the motor 54 to be actuable such that it does not provide the driveshaft 56 with drive torque, but is set to a preferably (damped) "idling mode" so that the driveshaft 56 coupled to the rotor of the motor 54 can be rotated relative to the stator in order to carry out vibration-damping movements. According to a development of said variant, the hydraulic motor 54 can be short-circuited when the lateral push drive device 52 is in the vibration-damping operating mode so that the oil supply line and the oil removal line of the hydraulic motor 54 are directly interconnected by means of a throttling point, and therefore the driveshaft 56 can be rotated in a braked manner and thus the lateral pusher 38 can carry out a vibration-damping movement relative to the lateral push frame 34 in order to damp vibrations. In this variant, too, after the vibrations have subsided, the motor 54 can be activated in order to move the lateral pusher back into a particular target position.

In another variant of the assembly shown in FIG. 4, a torsion spring, for example a torsion bar 59, as is indicated in FIG. 4 by dashed lines, can be provided in the drive train between the rotary drive motor 54 and the driveshaft 56, which spring can operate if the driveshaft 56 is rotationally deflected relative to the rotor of the drive motor 54 as a result of lateral vibrations of the lateral push frame 34, in order to generate a resilient restoring force that counteracts the rotary deflection. Such a torsion spring can reduce vibrations when the motor 54 generates a holding torque in order to hold the rotor still relative to the stator. Such a torsion spring can, however, also reduce vibrations when the motor 54 exerts a torque on the driveshaft 56.

In addition to means for resiliently restoring components in the drive train between the motor and the lateral push frame, which components are deflected relative to one another, movement-damping systems, in particular friction-damping systems, can also be provided, which, at least in the vibration-damping mode of the lateral push drive device 52, exert a braking effect on a relative movement between the lateral pusher 38 and the lateral push frame 34 in order to convert kinetic energy into another form of energy, in particular heat.

According to another variant of the assembly shown in FIG. 4, the rotary drive motor can be designed to be operated as a controllable adjusting component for actively reducing vibrations so as to drive the lateral pusher 38 to carry out vibration-reducing movements. This can take place in the separate vibration-damping mode of the lateral push drive device 52. According to a specific variant, a regular lateral push process of the lateral pusher can be superposed on an active vibration-reducing mode of this kind, so that the motor 54 drives the lateral pusher 38 to perform a regular lateral push movement and at the same time generates a vibration-reducing movement that modulates or is superposed on the lateral push movement.

A control device is provided to control the motor 54 in the manner desired in each case. Furthermore, sensors are preferably provided which detect vibration amplitudes of the mast or components that are arranged thereon in a height-adjustable manner, the control device being able to process data from said sensors in order to control the motor 54 as a controllable adjusting component for actively reducing vibrations in terms of optimised vibration reduction. In this regard, sensors can also be provided which detect the movement of the lateral pusher relative to the pivoting push frame.

In very general terms, in an industrial truck according to the invention, measures can be taken in order to recover the kinetic vibrational energy, which is dissipated or converted in the vibration-damping mode, in a useful form of energy, such as electrical energy, for example by means of a thermoelectric converter.

Situation example: as the industrial truck travels in a narrow aisle of a high-bay warehouse, the device for reducing vibrations is activated, a device that generates a braking effect, for example a friction-damping arrangement, providing a braking effect adapted to the current situation. If, when travelling over uneven floors, transverse acceleration occurs on the mast 8 and on the cab support 24 and therefore on the lateral push frame 34, the device generating the braking effect and optionally a spring arrangement transmits the transverse acceleration to the lateral pusher comprising the load-supporting apparatus and any load supported thereon. If the inertial force of the "softly coupled" masses exceeds the value of the braking force set and the optionally parallel-acting spring force, the lateral pusher 38 and the lateral push frame 34 move relative to one another. This forward and backward movement relative to a particular target rest position reduces the overall vibration amplitude and kinetic energy is predominantly converted into heat.

The invention claimed is:

1. An industrial truck comprising:

a mast;

a lateral push frame that is operable to move up and down on the mast;

a lateral pusher that is mounted on the lateral push frame so as to be laterally movable transversely to the main direction of travel of the industrial truck, such that said pusher has a degree of freedom of movement along the lateral push frame that is directed laterally, transversely to the main direction of travel of the industrial truck;

a load-supporting apparatus that is arranged on the lateral pusher and is operable to move laterally, together with the lateral pusher, transversely to the main direction of travel of the industrial truck using its degree of freedom of movement; and a lateral push drive device comprising a motor having (i) a stator and (ii) an active element moveable relative to the stator, wherein the movement of the active element is convertible into a movement of the lateral pusher along the lateral push frame, wherein the lateral push drive device is operable to be controlled by a control device of the industrial truck, for moving the lateral pusher together with the load-supporting apparatus along the lateral push frame, wherein the motor is operable to be controlled by the control device of the industrial truck, for generating a motor force between the stator and the active element, and wherein the lateral push drive device comprises a device for reducing transverse vibrations that are transverse to the main direction of travel of the industrial truck, wherein when in a vibration-damping operating mode, the lateral push drive device is operable as a component of the device for reducing vibrations, said lateral push drive device allowing the lateral pusher to carry out vibration-reducing movements relative to the lateral push frame in the vibration-damping operating mode.

2. The industrial truck according to claim 1, wherein the motor comprises one or more of: a controllable hydraulic motor or an electric motor, and wherein the generated motor force is influenced by correspondingly controlling the motor, in order to cause the active element and the lateral pusher to move or to stop.

3. The industrial truck according to claim 1, wherein when the lateral push drive device is in the vibration-damping operating mode, the motor is set so as to generate a holding torque that is capable of being overcome such that the active element counteracts a movement out of its particular position relative to the stator.

4. The industrial truck according to claim 1, wherein when the lateral push drive device is in the vibration-damping operating mode, the motor is capable of being actuated in order to generate a holding and restoring torque for holding the active element in a particular target position relative to the stator, and for restoring the active element to the target position if the active element is deflected out of the target position.

5. The industrial truck according to claim 4, wherein the motor is controllable such that the holding and restoring torque can be modulated on the basis of the deflection of the active element out of the target position.

6. The industrial truck according to claim 1, wherein a movement-damping arrangement of the device for reducing vibrations is provided, which arrangement acts between the lateral push frame and the lateral pusher when the lateral push drive device is in the vibration-damping operating mode, wherein the movement-damping arrangement functions according to the principle of friction.

7. The industrial truck according to claim 1, wherein a friction coupling is provided in the drive train of the lateral push drive device, and in that, when the lateral push drive device is in the vibration-damping operating mode, the motor is designed to prevent the active element from moving relative to the stator, wherein the friction coupling brakes relative movements between the lateral pusher and the lateral push frame, wherein the braking of the relative movements are a result of inertial effects.

8. The industrial truck according to claim 1, wherein the device for reducing vibrations comprises a resiliently yielding restoring device, which restoring device is designed to force the lateral pusher into a particular target position relative to the lateral push frame if the lateral pusher is deflected out of the particular target position when the lateral push drive device is in the vibration-damping operating mode.

9. The industrial truck according to claim 8, wherein the restoring device comprises a torsion spring arrangement in a driveshaft in the drive train of the lateral push drive device.

10. The industrial truck according to claim 1, wherein the device for reducing vibrations comprises at least one sensor for detecting movements of the lateral pusher relative to the lateral push frame, which sensor is connected to the control device in order to control the lateral push drive device.

11. The industrial truck according to claim 1, wherein the device for reducing vibrations comprises at least one sensor for detecting a vibrational state of the industrial truck, the sensor being connected to the control device that enables the vibration-damping operating mode of the lateral push drive device on the basis of a signal from the sensor.

12. The industrial truck according to claim 1, wherein the device for reducing vibrations is operable to be activated and deactivated.

13. The industrial truck according to claim 1, wherein the device for reducing vibrations dampens vibrations at the same time as movement of the lateral pusher, wherein movement of the lateral pusher is superposed on vibration-damping movements.

14. The industrial truck according to claim 1, wherein when the lateral push drive device is in the vibration-damping operating mode, the motor is operable as a controlled, active vibration-damping element in order to drive the lateral pusher to carry out vibration-reducing movements if transverse vibrations occur on the lateral push frame.

15. The industrial truck according to claim 1, wherein when the lateral push drive device is in the vibration-damping operating mode, the motor is further operable such that relative movements are allowed (i) between the stator and the active element and (ii) between the lateral push frame and the lateral pusher, as a result of inertial effects.

16. The industrial truck according to claim 15, wherein the motor is a hydraulic motor, which, when the lateral push drive device is in the vibration-damping operating mode, is operable to be hydraulically short-circuited by means of a flow resistor to generate a braking effect on relative movements between the stator and the active element of the motor and between the lateral push frame and the lateral pusher.

* * * * *